US008694146B2

(12) United States Patent
Doukakis et al.

(10) Patent No.: US 8,694,146 B2
(45) Date of Patent: Apr. 8, 2014

(54) COMPUTER SOFTWARE APPLICATION TO CREATE WEAVING MONOGRAMMING OF LETTERS AND SYMBOLS IN BOTH GRAPHIC AND EMBROIDERED OUTPUT

(76) Inventors: Ioannis Doukakis, Thermi (GR); Miltiadis Vasileiadis, Thermi (GR); Konstantinos Angelakis, Thermi (GR)

( * ) Notice: Subject to any disclaimer, the term of this patent is extended or adjusted under 35 U.S.C. 154(b) by 2 days.

(21) Appl. No.: 13/592,087

(22) Filed: Aug. 22, 2012

(65) Prior Publication Data

US 2013/0054002 A1 Feb. 28, 2013

Related U.S. Application Data

(60) Provisional application No. 61/528,002, filed on Aug. 26, 2011.

(51) Int. Cl.
*D05C 5/02* (2006.01)

(52) U.S. Cl.
USPC ..... 700/138; 112/470.01; 112/475.19

(58) Field of Classification Search
USPC ..... 700/136–138; 112/102.5, 470.01, 112/470.04, 470.06, 475.18, 475.19
See application file for complete search history.

(56) References Cited

U.S. PATENT DOCUMENTS

| | | | | |
|---|---|---|---|---|
| 4,841,891 | A * | 6/1989 | Hashimoto et al. | 112/475.05 |
| 5,357,442 | A * | 10/1994 | Sekine | 700/137 |
| 5,558,031 | A * | 9/1996 | Muto et al. | 112/102.5 |
| 5,943,972 | A * | 8/1999 | Hirata | 112/102.5 |
| 6,934,599 | B2 * | 8/2005 | Kaymer et al. | 700/138 |
| 6,947,808 | B2 * | 9/2005 | Goldman | 700/138 |
| 6,968,255 | B1 * | 11/2005 | Dimaridis et al. | 700/138 |

* cited by examiner

*Primary Examiner* — Nathan Durham
(74) *Attorney, Agent, or Firm* — John Alumit

(57) ABSTRACT

A method of creating embroidery designs with the use of embroidery software to weave overlapping graphemes to imitate monogramming by hand. A user-specified template for letter layout is designed so that letters overlap. Software reads the letters from a True-Type/Open-Type font file in vector form. Each individual letter is distorted to the template using 3$^{rd}$ degree Bezier Surfaces, 2$^{nd}$ degree Bezier curves and line segments are converted to 3$^{rd}$ degree Bezier curves. Software calculates the intersecting areas using 2-Dimensional Constructive Solid Geometry (CSG) to determine which letter will be on-top at each letter intersection, and sorts the intersecting areas into zones, wherein the top letter for each zone is toggled, letters within a zone are alternated, and only the top letter segment is shown. Software cuts out letter segments that will be below another letter at each intersection, and fills the weaved letter or grapheme areas with embroidery.

1 Claim, 3 Drawing Sheets

COMPUTER SOFTWARE APPLICATION TO CREATE WEAVING MONOGRAMMING OF LETTERS AND SYMBOLS IN BOTH GRAPHIC AND EMBROIDERED OUTPUT

CROSS-REFERENCE TO RELATED APPPLICATION

This present application claims the benefit of Provisional Application No. 61/528,002 filed Aug. 26, 2011. The prior application is incorporated herein by reference.

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

Monogramming is the procedure of making a motif by combining two or more letters or other overlapping graphemes to form one symbol. Monogramming can be done by hand or with the use of software-controlled machines. Existing embroidery computer software can create embroidery designs of uncombined graphemes (i.e. letters and/or other symbols) and even overlapping ones, but cannot weave the overlapping graphemes to imitate the monogramming made by hand. To achieve a monogram with an overlapping and weaved grapheme, the monogram must be created by hand or with the intervention of a software user.

For the foregoing reasons, there is a need for a monogramming software application that can weave overlapping graphemes without the intervention of a software user. This software application addresses the aforementioned existing problem by combining any two or more given letters and/or other symbols that are overlapping, by using special (innate) rules to weave the overlapping areas of the graphemes, to create one symbol.

SUMMARY

The present invention is directed to a process that satisfies the need for embroidery computer software capable of weaving overlapping areas of graphemes without user intervention. With the present invention, the user's intervention is limited to (a) selecting the letters/symbols to be used, including type of font, size of letter/symbol and font weight (b) setting the relative positions of the letters/symbols and, optionally, (c) modifying the layer at which each grapheme shall appear (top, bottom) on each intersection of two graphemes. The software can then output the monogramming in either vector graphic or embroidery design, which can then be embroidered with the use of an embroidery machine.

The process of the present invention comprises a procedure based on a 2-Dimensional subset of a Constructive Solid Geometry (CSG). It works on a 2D-vector representation of each letter using lines and/or Bezier curves. First, the software calculates all Boolean intersections of two or more letters/grapheme. Then, the software decides which letter/grapheme will be on the top layer on each of the intersections. To achieve the desired result, each letter must belong to the top layer for some intersections and to the bottom layer for the rest of the intersections. The user may change the result. Finally, the software subtracts (Boolean difference) from each letter/grapheme intersections that are set to the bottom-layer.

DRAWINGS

These and other features, aspects, and advantages of the present invention will become better understood with regard to the following description, appended claims, and accompanying drawings.

The invention does not require that all the advantageous features and all the advantages need to be incorporated into every embodiment of the invention.

DESCRIPTION

Figure 1:
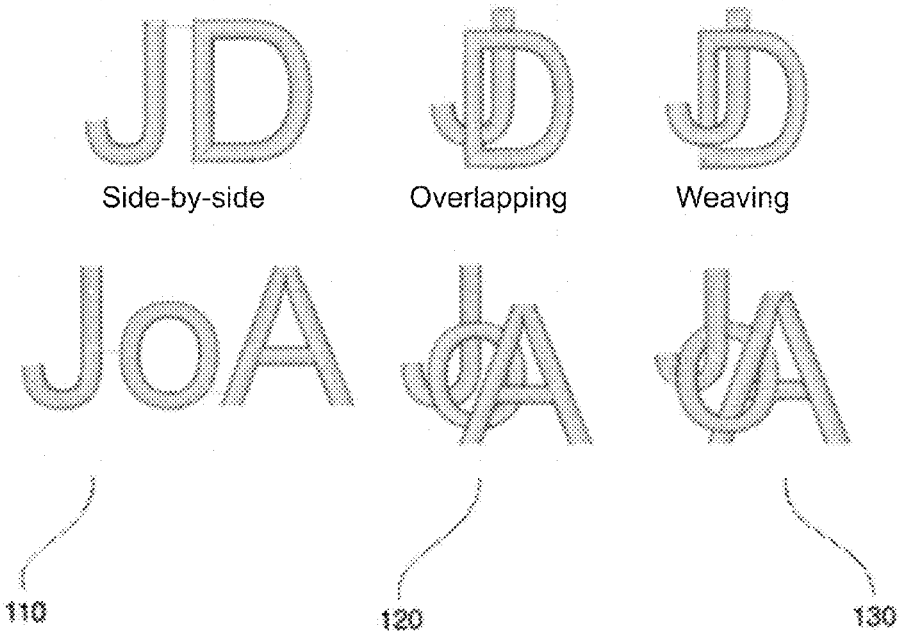
FIG. 1 illustrates various embroidery patterns.

Referring to FIG. 1, various embroidery patterns are illustrated: side-by-side 110, overlapping 120, and weaving 130. With a side-by-side 110 embroidery pattern, each letter of the monogram is placed next to each other with no letter being placed on top of or below another letter. With an overlapping 120 embroidery pattern, letters or graphemes are stacked on top of each other. The overlapping 120 letters or graphemes are either above or below each other, but not weaved together. With a weaving 130 embroidery pattern, letters or graphemes are stacked and may also be on top of and below another letter. Using the current invention, monogramming software can be used to weave overlapping letters or graphemes without the intervention of a software user.

The process begins with the software reading the user-specified True-Type/Open-Type font and letters that will be used in the monogramming.

Figure 2:
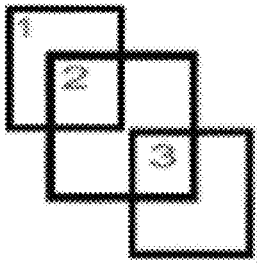
FIG. 2 illustrates an embroidery template for overlapping letters.

FIG. 2 illustrates a user-specified template that will be used for letter layout. The templates are designed in such a way that the letters overlap. Each character box is made of a $3^{rd}$ degree Bezier surface (16 control points) using two-dimensional control points.

Figure 3:
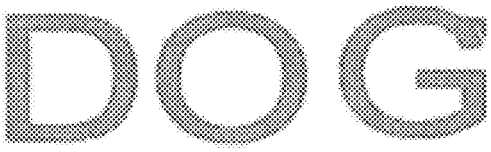
FIG. 3 illustrates the letters read by the software in vector form.

As shown in FIG. 3, the software then reads the letters from the True-Type/Open-Type font file in vector form ($2^{nd}$ degree Bezier curves and line segments).

Figure 4:
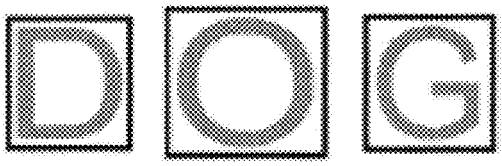
FIG. 4 illustrates the letters distorted to fit within the template.

In FIG. 4, each individual letter has been distorted to the template, using $3^{rd}$ degree Bezier Surfaces. At that stage, the $2^{nd}$ degree Bezier curves and line segments are converted to $3^{rd}$ degree Bezier curves.

Figure 5:
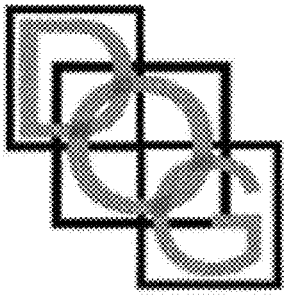
FIG. 5 illustrates the intersection(s) of each letter with another letter.

The software then calculates the intersecting areas using 2-Dimensional Constructive Solid Geometry (CSG) operations. It calculates the "intersection" of each pair of letters, and in the case of a 3-letter monogram, the intersection of all three letters, where applicable. These areas will be used later in the user interface of the software as areas that the user can click to manually override the software choices. As best illustrated in FIG. 5, the software has calculated two intersections between letters "D" and "O" and two between "O" and "G." In this example, there is no intersection between all three letters, "D" "O" and "G."

Figure 6:
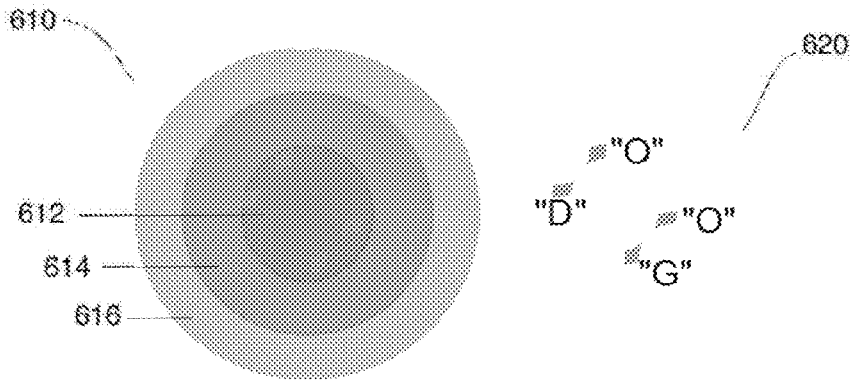
FIG. 6 illustrates how the software chooses which letter will be on-top on each intersection using zones.

To determine which letter will be on-top at each intersection of letters without user intervention, the software sorts the area into three zones 610. The three zones 610 comprise a center 612, middle 614, and outer 616 zone. Next, the letter which will be on top for each zone 610 is toggled. Within the zone 610 the software alternates letters. If all areas belong to a single zone, such as the center 612 zone illustrated in FIG. 6, the letters are alternated. For each area, the software decides that the top letter segments 620 will be as shown.

Figure 7:
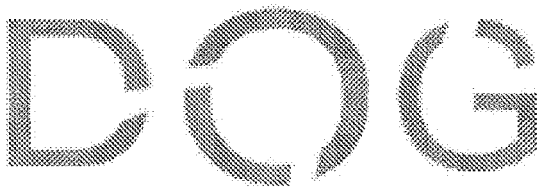
FIG. 7 illustrates how the portion of a letter that will be below another letter is calculated and cut-out, and the final outlines to be filled with embroidery appear.

For all the letter segments that will be below another letter at each intersection, the software performs the CSG operation "Difference" on this letter to cut-out the specific segments. The final outlines to be filled with embroidery for the monogram are illustrated in FIG. 7.

Figure 8:
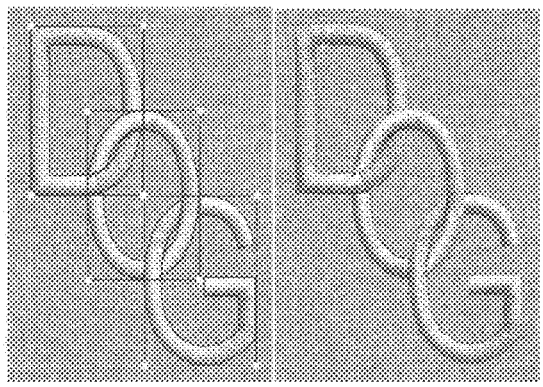
FIG. 8 illustrates the embroidery to be filled by the software with and without the template guidelines.

The software fills the weaved letter or grapheme areas with embroidery. The final embroidery, with and without the template guidelines, is illustrated in FIG. 8.

All features disclosed in this specification, including any accompanying claim, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed:

1. A method of creating embroidery designs with the use of embroidery software to weave overlapping graphemes that imitate monogramming by hand comprised of the following steps:

a user-specified template for letter layout designed to create overlapping letters is selected;

the software reads the letters from a True-Type or Open-Type font file in vector form;

each individual letter is distorted to the template using third degree Bezier Surfaces, second degree Bezier curves and line segments are converted to Third degree Bezier curves;

the software then calculates intersecting areas using Two-Dimensional Constructive Solid Geometry (CSG) operations to determine which letter will be on-top at each intersection of letters, and sorts the intersecting areas into a plurality of zones, wherein the letter which will be on top for each zone is toggled, the software alternates letters within a zone, and the software decides that a top letter segment will be shown;

the software then calculates the intersecting areas using Two-Dimensional Constructive Solid Geometry operations to cut out letter segments that will be below another letter at each intersection; and the software fills the weaved letters or grapheme areas with embroidery.

* * * * *